US007146748B2

(12) United States Patent
Swisher

(10) Patent No.: US 7,146,748 B2
(45) Date of Patent: Dec. 12, 2006

(54) SYSTEM FOR DRYING SHOPPING CARTS

(76) Inventor: Dorla J. Swisher, 77 Country Rd., Poca, WV (US) 25159

( * ) Notice: Subject to any disclaimer, the term of this patent is extended or adjusted under 35 U.S.C. 154(b) by 50 days.

(21) Appl. No.: 11/005,244

(22) Filed: Dec. 7, 2004

(65) Prior Publication Data

US 2006/0117590 A1 Jun. 8, 2006

(51) Int. Cl.
*F26B 7/00* (2006.01)

(52) U.S. Cl. ..... 34/438; 34/90; 34/106

(58) Field of Classification Search ..... 34/438, 34/90, 105, 106

See application file for complete search history.

(56) References Cited

U.S. PATENT DOCUMENTS

| | | | | |
|---|---|---|---|---|
| 2,997,048 | A | 8/1961 | Gertken et al. | |
| 3,096,775 | A | 7/1963 | Clarke et al. | |
| 3,258,019 | A | 6/1966 | Bellas et al. | |
| 3,444,867 | A | 5/1969 | Thornton | |
| 4,807,319 | A | 2/1989 | Poitevin | |
| 5,367,739 | A | 11/1994 | Johnson | |
| D387,859 | S | 12/1997 | Ukai et al. | |
| 5,875,565 | A | 3/1999 | Bowman | |
| 5,993,739 | A * | 11/1999 | Lyon | 422/31 |
| 6,090,218 | A | 7/2000 | Brackmann et al. | |
| D484,586 | S | 12/2003 | Intravatola | |
| 2002/0157208 | A1 | 10/2002 | MacNeil | |
| 2003/0203712 | A1 | 10/2003 | Nucci | |
| 2005/0121057 | A1 * | 6/2005 | Knowlton et al. | 134/68 |

FOREIGN PATENT DOCUMENTS

| | | |
|---|---|---|
| JP | 4-27646 | 1/1992 |
| JP | 6-115410 | 4/1994 |

* cited by examiner

*Primary Examiner*—Stephen Gravini
(74) *Attorney, Agent, or Firm*—Richard C. Litman

(57) ABSTRACT

The system for drying shopping carts dries a large number of wet shopping carts. The carts are loaded onto a conveyor belt. Side dryers located on either side of the conveyor belt initially dry the carts. The carts are passed under a free-standing arch having support columns situated on either side of the conveyor belt. The arch includes a number of overhead dryers. When the carts move under the arch, they are dried from above by the overhead dryers. Water dispelled from the shopping carts runs into a drainage system situated on the floor. Once the shopping carts are dried, the carts are unloaded from the conveyor belt and are removed from the housing.

5 Claims, 3 Drawing Sheets

SYSTEM FOR DRYING SHOPPING CARTS

BACKGROUND OF THE INVENTION

1. Field of the Invention

The present invention relates to drying systems, and particularly to a system for drying wet shopping carts.

2. Description of the Related Art

Supermarkets, grocery stores and retail stores often provide shopping carts for their customers to use in transporting groceries or heavy items. The shopping carts are almost always taken out to the customers' cars in order to unload the items bought. After unloading their items, the customers bring the carts back, leave them in special cart-specific enclosures or simply abandon them, wherever is convenient for the customer.

When the shopping carts are left outside, they are often rained or snowed on whenever the weather becomes inclement. After being taken back inside the store, the shopping carts are simply left wet to eventually dry naturally. While air-drying does allow the shopping carts to dry, it takes a good deal of time to do so. Wet carts become an inconvenience for customers shopping for groceries and even more problematic for customers shopping for clothing, bedding or other such items that may become soaked by the excess water.

Some cart drying systems do dry the shopping carts, but generally only after a cumbersome cleaning process. These drying systems tend not to be able to dry large numbers of shopping carts at the same time. Further, the dryers are often attached to a housing, which makes it more difficult to fix dryers that need repair than if they were freestanding dryers and easily removable.

Accordingly, there is a need for a cart drying system that provides a large enough moving mechanism to dry a great number of carts at the same time. Additionally, there is a need for a cart drying system that has freestanding, easily replaceable dryers. Thus a system for drying shopping carts solving the aforementioned problems is desired.

SUMMARY OF THE INVENTION

The system for drying shopping carts is a system that dries shopping carts that have become wet, usually by exposure to rain or snow. The cart drying system utilizes a conveyor belt for moving the wet shopping carts through the drying facility, and both side and overhead freestanding dryers are used to dry the shopping carts. The conveyor belt and the side and overhead dryers are located within a housing.

The cart drying system comprises a housing, a conveyor belt, a plurality of freestanding side dryers and a freestanding arch having a plurality of overhead dryers mounted onto the arch. The cart drying system includes a drainage system. The conveyor belt is disposed within the housing and is designed to hold multiple columns of shopping carts. The side dryers are placed on either side of the conveyor belt, and the freestanding arch is placed above the conveyor belt with its support columns on either side of the belt. Overhead dryers are integrally connected to an overhead beam on the arch.

Wet shopping carts are gathered together, brought into the housing, and loaded onto the conveyor belt. The freestanding side dryers, which are disposed on either side of the conveyor belt, are activated and dry the sides of the wet shopping carts. The carts are then transported down the conveyor belt, the overhead dryers attached to the overhead beam are activated, and the shopping carts are dried from above.

The water dispelled from the shopping carts runs into a drainage system situated on the floor. Once the shopping carts are dried, the carts are unloaded from the conveyor belt and are removed from the housing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
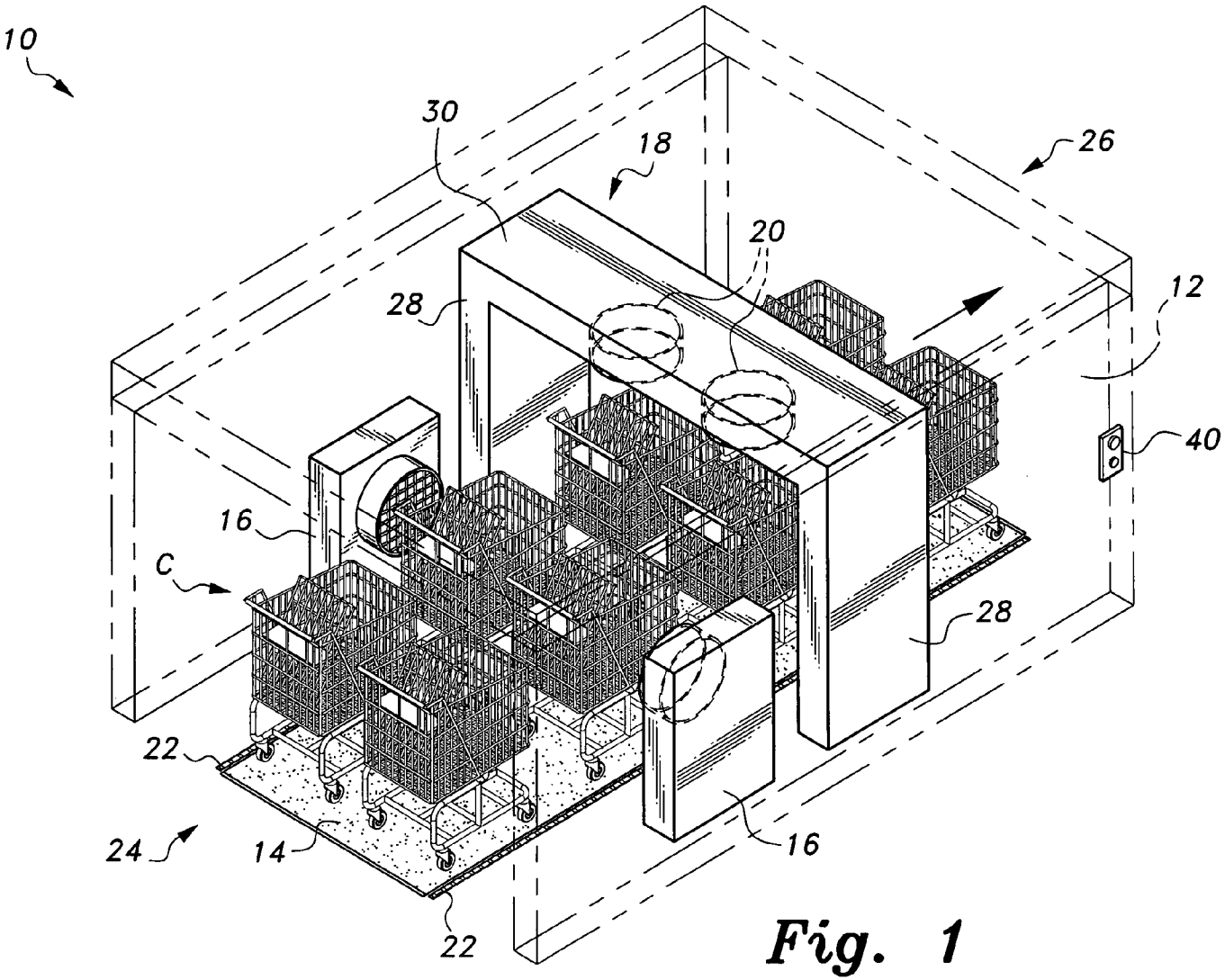
FIG. 1 is an environmental, perspective view of a system for drying shopping carts according to the present invention.

The present invention is a system for drying shopping carts, designated generally as 10 in the drawings. The system for drying shopping carts 10 fully dries shopping carts that have been made wet by rain, snow, or for any other reason.

Referring first to FIG. 1, a perspective view of the system for drying shopping carts 10 is shown. The cart drying system 10 includes a conveyor belt 14 for moving shopping carts C, and also includes side 16 and overhead 20 freestanding dryers for drying the shopping carts C. The conveyor belt 14, side 16 and overhead 20 freestanding dryers are located within a housing 12.

Figure 2:
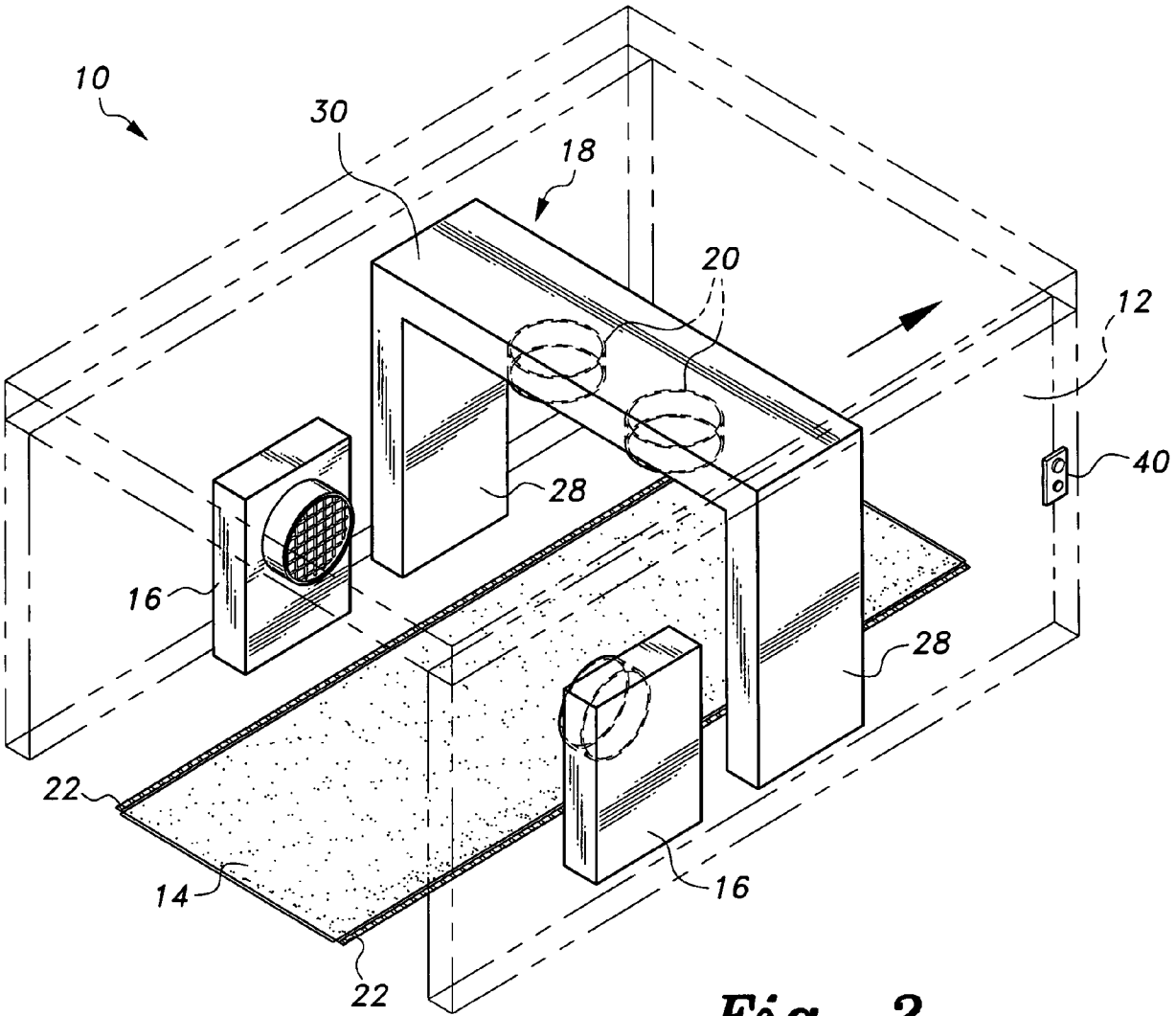
FIG. 2 is a perspective view of the system for drying shopping carts according to the present invention with the carts omitted.

Turning now to FIG. 2, a perspective view of the cart drying system 10 is shown without the presence of the shopping carts C. The cart drying system 10 comprises a housing 12, a conveyor belt 14, a plurality of freestanding side dryers 16 and a freestanding arch 18 having a plurality of overhead dryers 20 mounted onto the arch 18. Additionally, the cart drying system 10 may include a drainage system 22.

The housing 12 includes an entrance 24 for the shopping carts C to enter the system 10 and an exit 26 through which they may be removed. The conveyor belt 14 is disposed within the housing 12 and is designed to hold multiple columns of shopping carts C so that more shopping carts may be dried quickly. While a large conveyor belt 14 capable of holding multiple columns of carts C is shown, multiple belts, each holding one column of carts C, may be substituted for the extra wide conveyor belt 14. Freestanding side dryers 16 are disposed on either side of the conveyor belt 14. The freestanding arch 18 has two opposing support columns 28 and an overhead beam 30 connecting the two support columns 28. The support columns 28 are set on opposite sides of the conveyor belt 14. Overhead dryers 20 are integrally connected to the overhead beam 30 on the arch 18.

The side dryers 16 and the arch 18 having the overhead dryers 20 are all removable, such that if a dryer 16 or 20 needs to be repaired, the dryers 16 or the arch 18 may simply be removed, repaired, and then easily returned.

Referring back to FIG. 1, wet shopping carts C are gathered together and brought through the entrance 24 of the housing 12. The shopping carts C are loaded onto the conveyor belt 14 that is disposed within the housing 12. The shopping carts C are lined up on the conveyor belt 14, either separately or locked together in columns. Once the carts C have been loaded, an individual outside of the housing 12 operates a switch 40 located on the outer surface of the housing 12. The switch 40 may operate the conveyor belt 14 and/or the dryers 16 and 20. Upon operation, the shopping carts C progress along the conveyor belt 14.

The freestanding side dryers 16, which are disposed on either side of the conveyor belt 14, are activated and then dry the sides of the wet shopping carts C. As the carts C are transported down the conveyor belt 14, the carts C move under the arch 18. The overhead dryers 20, attached to the overhead beam 30 are activated and blow air down onto the shopping carts C.

The water is dispelled from the shopping carts C and runs into a drainage system 22. The drainage system 22 is situated on the floor and runs the length of the conveyor belt 14. While an elongated drainage system 22 is shown, any other drainage system may be used that drains the runoff water.

Once the shopping carts C are dried, the carts C are unloaded from the conveyor belt 14. The dry carts C then are removed from the housing 12 through the exit 26.

Figure 3:
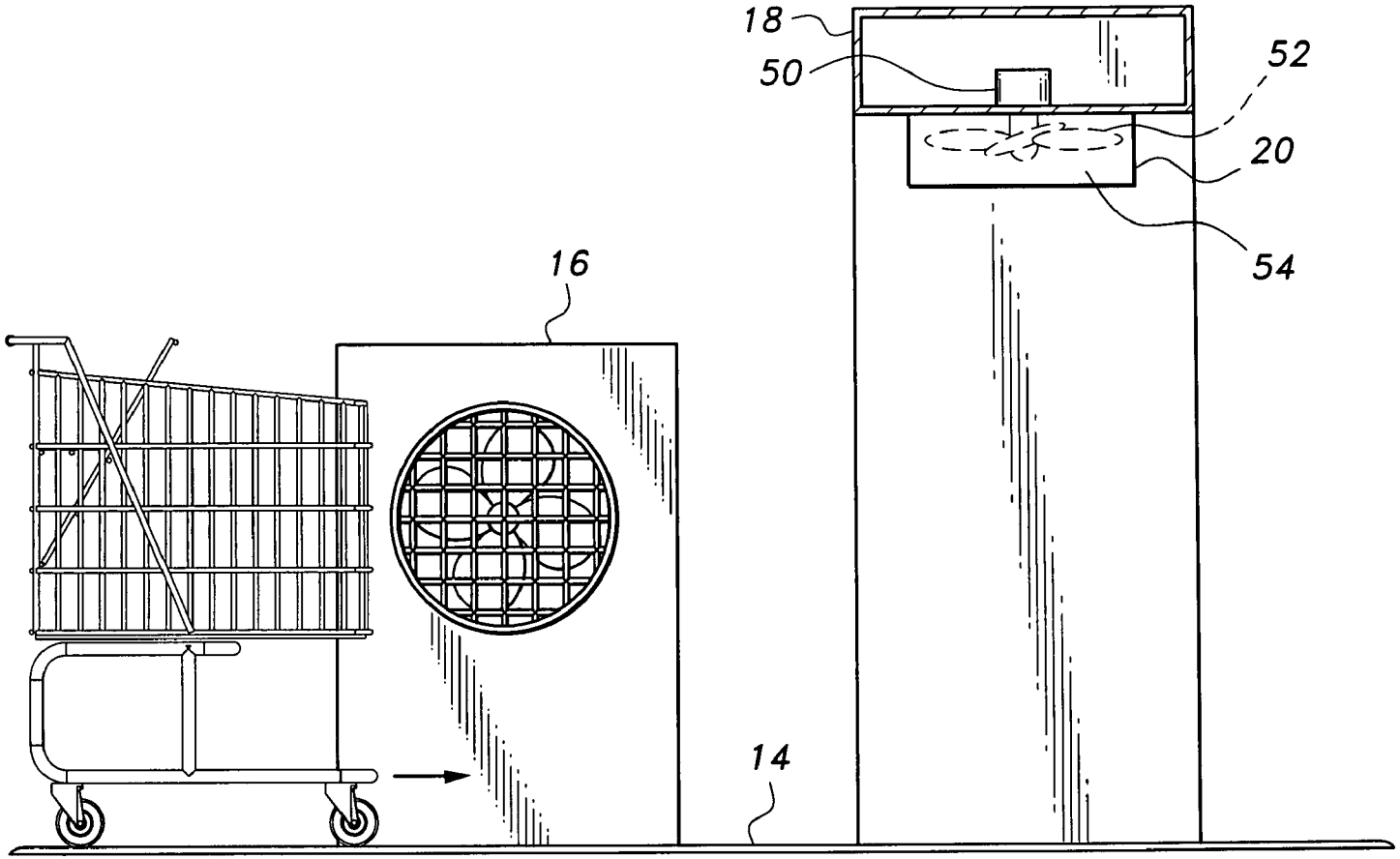
FIG. 3 is a diagrammatic side view, partially in section, of the system for drying shopping carts according to the present invention.

Turning now to FIG. 3, a diagrammatic side view of the system 10 is shown, partly in section. The shopping carts C move along the conveyor belt 14 and first pass in front of the side dryers 16, which partially dry the shopping carts C. The carts 16 then pass under the arch 18 disposed above the conveyor belt 14. The arch 18 has support columns 28 and an overhead beam 30 that connects the support columns 28. Attached to the overhead beam 30 are a plurality of overhead dryers 20. Each of the overheard dryers 20 has a motor 50, a plurality of fan blades 52, and a shroud 54 for protecting the fan blades 52. The motor 50 drives the fan blades 52 so that the overhead dryers 20 may operate correctly. Once dried under the overhead dryers 20 on the arch 18, the shopping carts C move along the conveyor belt 14 and are eventually unloaded from the belt 14.

It is to be understood that the present invention is not limited to the embodiment described above, but encompasses any and all embodiments within the scope of the following claims.

I claim:

1. A system for drying shopping carts, comprising:

a housing;

a conveyor belt for moving the shopping carts, the conveyor belt being disposed within the housing;

a plurality of freestanding side dryers disposed on either side of the conveyor belt;

an arch having opposing support columns set on opposite sides of the conveyor belt; and at least one overhead dryer mounted on the arch.

2. The system for drying shopping carts according to claim 1, further comprising a drainage system located within the housing.

3. The system for drying shopping carts according to claim 1, further comprising a switch disposed on the outside of the housing, the switch being operatively connected to the conveyor belt.

4. A system for drying shopping carts, consisting essentially of:

a housing;

a conveyor system for moving the shopping carts, the conveyor system disposed within the housing;

a plurality of freestanding dryers disposed on either side and above the conveyor belt; and a drainage system located within the housing.

5. A method for drying wet shopping carts, comprising the steps of:

gathering wet shopping carts and introducing the carts into a housing;

loading the shopping carts onto a conveyor belt disposed within the housing;

drying the shopping carts with a plurality of freestanding side dryers disposed on either side of the conveyor belt and at least one overhead dryer mounted on an arch, the arch having opposing support columns set on opposite sides of the conveyor belt;

draining the water off of the shopping carts into a drainage system; and unloading the dry shopping carts from the conveyor belt.

* * * * *